US010900310B2

(12) United States Patent
Melton et al.

(10) Patent No.: US 10,900,310 B2
(45) Date of Patent: Jan. 26, 2021

(54) INSTALLING A TUBULAR STRING THROUGH A BLOWOUT PREVENTER

(71) Applicant: Downing Wellhead Equipment, LLC, Oklahoma City, OK (US)

(72) Inventors: Matthew E. Melton, Norman, OK (US); Brian C. Wiesner, Edmond, OK (US); Steven L. Kirksey, Oklahoma City, OK (US); Sean A. Jeanes, Yukon, OK (US); Steven K. Burrows, Chandler, OK (US)

(73) Assignee: Downing Wellhead Equipment, LLC, Oklahoma City, OK (US)

( * ) Notice: Subject to any disclaimer, the term of this patent is extended or adjusted under 35 U.S.C. 154(b) by 110 days.

(21) Appl. No.: 16/129,597

(22) Filed: Sep. 12, 2018

(65) Prior Publication Data

US 2019/0078409 A1 Mar. 14, 2019

Related U.S. Application Data

(60) Provisional application No. 62/667,279, filed on May 4, 2018, provisional application No. 62/557,617, filed on Sep. 12, 2017.

(51) Int. Cl.

| | |
|---|---|
| ***E21B 29/00*** | (2006.01) |
| ***E21B 33/06*** | (2006.01) |
| ***E21B 31/16*** | (2006.01) |

(52) U.S. Cl.

CPC ..... *E21B 29/002* (2013.01); *E21B 31/16* (2013.01); *E21B 33/06* (2013.01); *E21B 33/063* (2013.01)

(58) Field of Classification Search

CPC ..... E21B 29/00; E21B 29/06; E21B 29/002; E21B 29/005; E21B 29/08; E21B 33/047; E21B 33/06; E21B 33/061; E21B 33/062; E21B 33/063; E21B 33/122; E21B 31/16; E21B 43/114

See application file for complete search history.

(56) References Cited

U.S. PATENT DOCUMENTS

| | | | | |
|---|---|---|---|---|
| 2,525,391 A * | 10/1950 | Bates | E21B 29/00 451/76 |
| 5,253,710 A | 10/1993 | Carter et al. | |
| 5,381,631 A * | 1/1995 | Raghavan | B24C 1/045 166/298 |
| 5,996,695 A | 12/1999 | Koleilat et al. | |
| 6,065,542 A | 5/2000 | Lalor et al. | |
| 6,095,242 A | 8/2000 | Lequang et al. | |

(Continued)

OTHER PUBLICATIONS

International Search Report and Written Opinion in International Application PCT/US2018/050614 dated Nov. 8, 2018, 8 pages.

*Primary Examiner* — David Carroll
(74) *Attorney, Agent, or Firm* — Fish & Richardson P.C.

(57) ABSTRACT

A tubular string is cut using a severing system deployed from the rig floor inserted through the BOP into the tubular string and landed in a fit-for-purpose wellhead. The cutting operation forms an excess tubular string and a remaining tubular string. Once cut, the excess tubular string is removed through the BOP. The system and its use eliminates the need to perform a cutting operation at the wellhead by personnel under the rig floor and the need for removal of the BOP thus reducing cost, saving time, and eliminating the inherent risk attendant with these operations.

18 Claims, 3 Drawing Sheets

(56) References Cited

U.S. PATENT DOCUMENTS

| | | | | |
|---|---|---|---|---|
| 6,138,774 | A * | 10/2000 | Bourgoyne, Jr. | E21B 21/001 175/7 |
| 6,805,200 | B2 | 10/2004 | DeBerry | |
| 7,134,490 | B2 | 11/2006 | Nguyen | |
| 8,196,649 | B2 | 6/2012 | Allen et al. | |
| 8,261,837 | B2 | 9/2012 | Leonard et al. | |
| 8,424,607 | B2 | 4/2013 | Springett et al. | |
| 8,479,824 | B2 | 7/2013 | Travis et al. | |
| 8,511,393 | B2 | 8/2013 | Nguyen | |
| 8,668,020 | B2 | 3/2014 | Guitierrez et al. | |
| 8,960,276 | B2 | 2/2015 | Lang et al. | |
| 9,038,712 | B1 | 5/2015 | Streety et al. | |
| 9,085,950 | B2 | 7/2015 | Spacek | |
| 9,464,496 | B2 | 10/2016 | O'Rourke et al. | |
| RE46,241 | E | 12/2016 | Cain et al. | |
| 9,534,465 | B2 | 1/2017 | Nguyen et al. | |
| 9,702,211 | B2 | 7/2017 | Tinnen | |
| 9,745,816 | B2 | 8/2017 | Milne et al. | |
| 9,926,758 | B1 | 3/2018 | Adkins et al. | |
| 2012/0013893 | A1 | 1/2012 | Maida et al. | |
| 2013/0213636 | A1* | 8/2013 | McAfee | E21B 7/18 166/222 |
| 2014/0090846 | A1* | 4/2014 | Deutch | E21B 29/00 166/297 |
| 2014/0231087 | A1* | 8/2014 | Orstad | E21B 31/16 166/298 |
| 2014/0251616 | A1* | 9/2014 | O'Rourke | E21B 31/20 166/298 |
| 2016/0215580 | A1* | 7/2016 | Lehr | E21B 29/002 |
| 2017/0101840 | A1 | 4/2017 | Kauffmann et al. | |
| 2018/0245450 | A1* | 8/2018 | Stokes | E21B 29/02 |
| 2018/0313156 | A1* | 11/2018 | Steele | E21B 7/061 |

* cited by examiner

INSTALLING A TUBULAR STRING THROUGH A BLOWOUT PREVENTER

CROSS-REFERENCE TO RELATED APPLICATIONS

This application claims the benefit of priority to U.S. Provisional Application Ser. No. 62/557,617, filed on Sep. 12, 2017 and U.S. Provisional Application Ser. No. 62/667,279, filed on May 4, 2018, the contents of which are hereby incorporated by reference.

TECHNICAL FIELD

The present disclosure relates to drilling operations, including installing tubulars in a well.

BACKGROUND

In a well for hydrocarbon production, at least a part of the wellbore is lined with a pipe, or tubular. In certain instances, the tubular supports against collapse of the surrounding Earth and prevents fluid communication with geologic formations the well is not intended to reach. Certain types of these tubulars can be referred to as casings or liners. Tubulars come as lengths, or joints, that are threaded together, or as a single spool. Once in the wellbore, cement is introduced into the annulus between the tubular and the wellbore to seal and anchor the tubular in place. Typically, a surface tubular is set at the top of the wellbore, concentrically within a conductor (the first tubular string that is inserted into the well, particularly on land wells, is to prevent the sides of the hole from caving into the wellbore) and additional lengths of tubulars are set concentrically within the surface tubular and reach deeper into the Earth. The surface tubular is connected to a flange, commonly referred to as a wellhead. The wellhead is typically secured to the tubular by welding, screwing, or clamping. A blowout preventer (BOP) is attached to the wellhead during the wellbore construction to control pressure. The wellhead's purpose is to support multiple tubular strings, attach the well to the rig and the BOP during well construction, isolate annular pressure during and after well construction, connect to the stimulation equipment during the fracturing operations, and connect to the production and surface equipment during flowback and production operations.

To achieve this, the intermediate tubular is cut to length after installation, or, if not cut, the intermediate tubular is spaced out with shorter lengths of tubulars, called pups, to terminate at the desired depth, or an additional length of wellbore, called a rat hole, is drilled to accommodate the unneeded, additional tubular length. Each accommodation presents operational difficulties. For example, the intermediate (and subsequent) tubular is installed into the surface tubular through the BOP. Thus, when the tubular is cut, the BOP is removed to allow access for the cut, and then reinstalled afterwards. Moreover, the tubular is typically cut manually under the rig with a torch, and then beveled (to provide an entrance bevel), again typically done manually by a service person under the rig with a grinder. Cutting the tubular in this manner results in both the operational expense and safety concerns of removing and reinstalling the BOP (i.e., to disassemble and reassemble the BOP to the wellhead), as well as having workers in a hazardous environment below the rig floor. Installations where the tubular is not cut also add operational expense and complexity, for example, to size and install the pups needed to space out the uppermost intermediate tubular joint, to drill the rat hole, and to prepare and transport the matched hanger and pups to the drill site.

SUMMARY

The present disclosure relates to installing multiple tubular strings through a blowout preventer.

An example implementation of the subject matter described within this disclosure is a method with the following features. A tubular string is severed using a severing system inserted through the BOP. The severing forms an excess tubular string and a remaining tubular string. The excess tubular string is removed through the BOP.

Aspects of the example implementation, which can be combined with the example implementation alone or in combination, include the following. The tubular string is inserted into a wellbore through a BOP. The tubular string is set to be supported within the wellbore.

Aspects of the example implementation, which can be combined with the example implementation alone or in combination, include the following. Severing includes severing the tubular from inside the tubular.

Aspects of the example implementation, which can be combined with the example implementation alone or in combination, include the following. Severing the tubular string includes using a water jet cutter.

Aspects of the example implementation, which can be combined with the example implementation alone or in combination, include the following. The water jet cutter directs a high velocity jet of fluid with a suspended abrasive media.

Aspects of the example implementation, which can be combined with the example implementation alone or in combination, include the following. The severing system is supported from a rig.

Aspects of the example implementation, which can be combined with the example implementation alone or in combination, include the following. The severing system is supported on a rod, drill string, or coiled tubing.

Aspects of the example implementation, which can be combined with the example implementation alone or in combination, include the following. The tubular is severed above the cellar floor and below the BOP. In certain instances, the tubing can be severed below the cellar floor.

Aspects of the example implementation, which can be combined with the example implementation alone or in combination, include the following. A proximity sensor is located within the wellhead. The severing system is located based on the proximity sensor.

An example implementation of the subject matter described within this disclosure is a casing cutting system with the following features. A grapple assembly is configured to support a tubular string. The grapple assembly is configured to be inserted into the tubular string and support the tubular string by an inner wall of the tubular string. A rotatable drive tube passes through the center of the grapple assembly. The drive tube is configured to be rotated. A tubular string cutter assembly is positioned at a downhole end of the drive tube. The tubular string cutter assembly is positioned downhole of the grapple assembly. The tubular string cutter is configured to sever the tubular string.

Aspects of the example system, which can be combined with the example system alone or in combination, include the following. The tubular string cutter assembly includes a water jet cutter head configured to be rotated within the tubular string. The water jet cutter is rotatable by the rotatable drive tube. The water jet cutter is configured to direct a high velocity fluid jet at the inner wall of the tubular string. A media line is configured to deliver a liquid media to the water jet cutter head. An instrumentation line is configured to exchange commands and data with the water jet cutter head.

Aspects of the example system, which can be combined with the example system alone or in combination, include the following. A support assembly includes a main body positioned at a downhole end of the grapple assembly. A bearing assembly is configured to radially support the drive tube and the cutter assembly.

Aspects of the example system, which can be combined with the example system alone or in combination, include the following. The media line is a first media line. The tubular string cutter assembly further includes a second media line configured to deliver a second media to the water jet cutter head. A mixer is configured to mix the liquid media and second media.

Aspects of the example system, which can be combined with the example system alone or in combination, include the following. The second media line is configured to carry an abrasive media.

Aspects of the example system, which can be combined with the example system alone or in combination, include the following. The grapple assembly includes a mechanically or hydraulically actuated expandable slip. The slip is configured to grip the tubular casing with a friction fit.

Aspects of the example system, which can be combined with the example system alone or in combination, include the following. A proximity sensor is positioned within the tubular string. The proximity sensor is positioned such that the tubular string cutter can be positioned based on the proximity sensor.

Aspects of the example system, which can be combined with the example system alone or in combination, include the following. The proximity sensor is positioned above a cellar floor and below a BOP.

An example implementation of the subject matter described within this disclosure is a method performed through a BOP on a wellbore with the following features. A tubular string is inserted into a wellbore through a BOP. The tubular string is set to be supported within the wellbore. The tubular string, is severed from inside the tubular string using a water-jet cutting system inserted through the BOP. The severing forms an excess tubular string and a remaining tubular string. The excess tubular string is removed through the BOP.

Aspects of the example system, which can be combined with the example system alone or in combination, include the following. The water-jet cutting system is supported on a rod, drill string, or coiled tubing.

Aspects of the example system, which can be combined with the example system alone or in combination, include the following. The tubular is severed above a cellar floor and below the BOP.

Aspects of the example system, which can be combined with the example system alone or in combination, include the following. Severing the tubular string includes beveling the remaining tubular string.

BRIEF DESCRIPTION OF THE DRAWINGS

Like reference numbers and designations in the various drawings indicate like elements.

DETAILED DESCRIPTION

This disclosure describes a system that includes a fit-for-purpose wellhead, a tubular severing system, and an operational procedure for deploying the tubular severing system. Specifically, this disclosure describes deploying a tubular severing system through the BOP to enable severing the tubular at a specific depth while maintaining the BOP in place. A tubular severing system is deployed on a rod, drill string, coiled tubing, wireline or other suspension method through or around the tubular and through the BOP. The tubular severing system cuts the tubular from inside or outside of the tubular at the desired depth. The tubular severing system may, in certain instances, also cut the entrance bevel or a separate dressing tool may be used to cut the entrance bevel. Thus, the tubular is lowered into the hole, cemented in place, and the tubular suspension device (TSD) deployed from the rig into the annulus.

After the TSD is installed, the tubular is cut to the desired depth with the tubular severing system through the BOP. The TSD can be installed before or after cementing. The system may use any number of sensors or location methods, (for example, proximity sensors on the wellhead, linear variable differential transformers (LVDT), and/or a shoulder or stop in the wellhead) to precisely position the depth of the severing system. The severing system can be centralized through any number of centralizing methods including, but not limited to, packers, centralizers, expandable elements, etc. A fit-for-purpose wellhead can be used, in certain instances, to facilitate the deployment of the severing system. The wellhead can eliminate extraneous features common in current wellheads, and facilitate the installation of a TSD. Although discussed in reference to a fit-for-purpose wellhead, the concepts herein are equally applicable to other types of wellheads, including conventional wellheads.

Aspects of this disclosure include many advantages beyond the cost and time saved by not having to remove and reinstall the BOP. For example, the tubular can be rotated and reciprocated during the cementing process because the tubular can be supported by the rig during cementing. Rotating and reciprocating the tubular helps better position the cement around the tubular. Unlike the traditional method of severing the tubular, this system eliminates the need for personnel to work under the rig or use a torch on an open well. There is no need to space the tubular or to drill an unnecessary rat hole, as required when an alternate TSD is used. The system is safer as a result of the wellhead and BOP remaining intact (i.e., no repeated remove/reinstall of sealed connections) allowing the BOP rams to remain in place as a secondary seal in case of an unanticipated well event.

Figure 1:
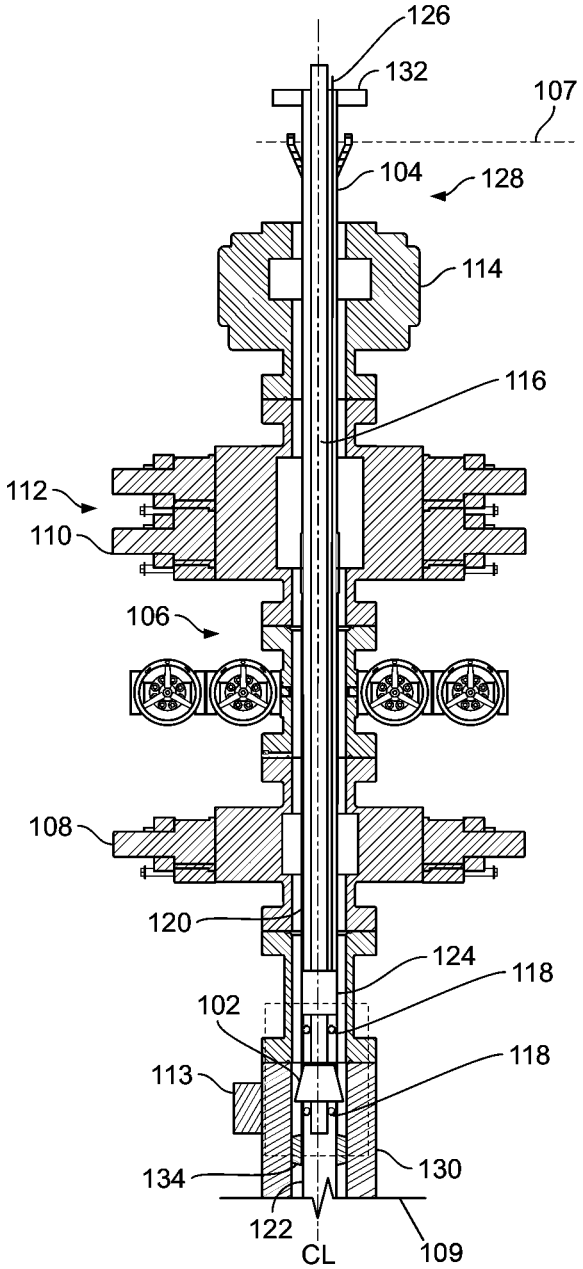
FIG. 1 is a half, side cross-sectional view of a well with an example tubular severing system, wellhead, and BOP.

FIG. 1 is a half, side cross-sectional view of an example well with a tubular severing system 102 positioned within a tubular string 104 that is positioned within a fit-for-purpose wellhead 130. In the illustrated implementation, the BOP 106 is positioned atop a wellhead 130 and includes a set of pipe rams 108, a set of blind pipe rams 110, a set of upper pipe rams 112, and an annular ram 114. In some implementations, the ram configuration can include additional, fewer, and/or different rams and still be within the scope of this disclosure. The various rams are configured to seal around the tubular and/or drill string and seal the wellbore in the event of an unexpected hydrocarbon release, also known as a "kick".

The tubular string 104 is lowered through the BOP 106 and into the wellbore from the rig floor 107. The tubular string 104 is held in place by the rig (not shown, but rig floor 107 labeled) during insertion, but is subsequently supported by the floor slips 128. The TSD 134 is used to suspend the tubular in the wellhead. Slips and mandrels are commonly used for wellhead TSD 134. The TSD 134 can be installed before or after the tubular string 104 has been cemented in the wellbore. In some implementations, the TSD 134 can be lowered to its desired location from the rig floor 107. That is, the TSD 134 can be dropped down the annulus of the tubular and through the BOP 106 to their designated locations. The TSD 134 can be landed on a machined ledge, known as a load shoulder, and/or guide pin. In some implementations, a reference fitting 132 can be attached to the top of the tubular string 104. The reference fitting aids in determining the position of the string 104 (the apparatus that is attached to the severing system to position and operate it), retrieving the string 104, and centralizing the string 104.

Once the tubular string 104 has been set, a severing system 102 is lowered into the tubular string 104 to a pre-determined depth. The severing system 102 may use any number of sensors, such as proximity sensor 113, or location methods, (for example, linear variable differential transformers (LVDT), and/or a shoulder or stop in the wellhead) to precisely position the depth of the severing system. The proximity sensor 113 can be positioned anywhere along the inside or outside of the well bore so long as the proximity sensor can be used to determine a position of the severing system 102. For example, the proximity sensor 113 can be positioned within the well bore. In some implementations, the proximity sensor 113 is positioned above the cellar floor 109 and below the BOP 106. The severing system 102 is attached to the downhole end of a drill pipe or other form of conveyance 116 (e.g., a rod, drill string, or coiled tubing) that is controlled and supported by the rig. The severing system is attached to the drill pipe or other form of conveyance 116 with a grapple system 124. The severing system 102 is configured to cut the tubular string 104 at the predetermined height and separate it into two pieces: an excess tubular section 120 and a remaining tubular section 122. The excess tubular section 120 can be removed through the BOP 106 by either the severing system 102 attached to the excess tubular, a separate fishing tool, or by existing equipment on the rig. The severing system 102 can include a saw, individual blades, laser severing devices, water jet and/or any other cutting/severing mechanism. In some implementations, the severing system can also be configured to bevel, deburr, and otherwise prepare the cut on the remaining tubular section 122 for adding additional sealing components that require a seal to be fit over the bevel. In some implementations, a separate grinding or dressing tool can be used for a similar effect. The cutting and preparation of the remaining tubular section 122 is completed without the need to remove the BOP 106. In the described method, avoiding the need to remove the BOP 106 results in no additional workers, saves time and money, and eliminates the inherent risk to personnel attendant to the removal of the BOP 106.

In certain instances, the severing system 102 is activated (e.g., extended radially outward) via a control line 126 or wireless connectivity. The control line 126 can be hydraulic, electric, and/or activated in another manner. Thereafter, in one embodiment, the severing system 102 can be operated to sever the tubing via a number of different methods including, but not limited to, rotation from the rig floor 107, hydraulic actuation, electric actuation, or any other method generating the power required to activate the severing system. The tubular is severed above the cellar floor 109 and below the BOP 106. In certain instances, the tubing can be severed below the cellar floor 109. In the illustrated implementation, the severing system 102 is centralized within the tubular by one or more centralizers 118. The centralizers can include spring centralizers, packers, expandable arms, and/or another type of centralizing method.

Figure 2:
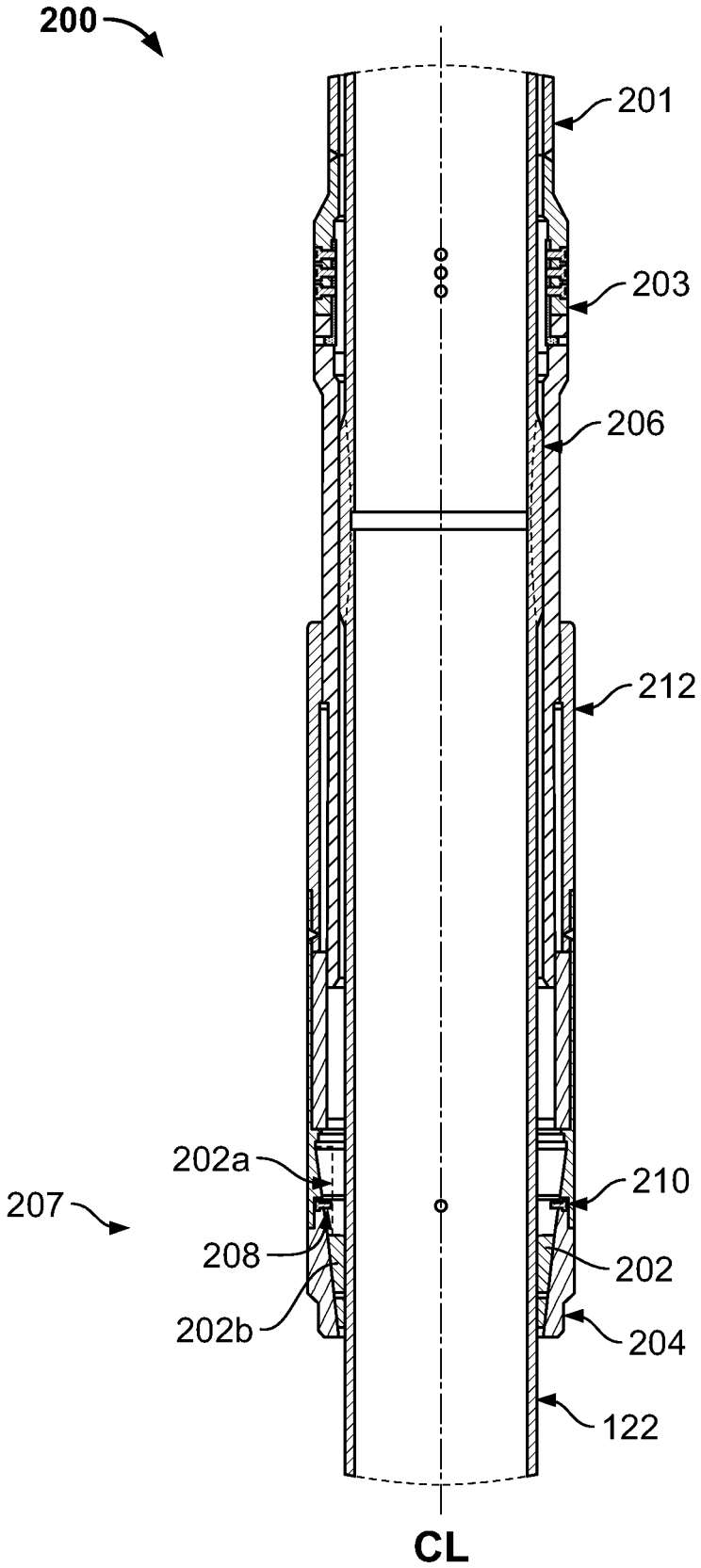
FIG. 2 is a half, side cross-sectional view of an example setting tool.

FIG. 2 is a half, side cross-sectional view of an example tubular running tool 200. The casing running tool is used for controlled deployment and setting of one or more casing hanger slips 202 into a supporting wellhead 130 through a BOP 106 (FIG. 1). The running tool 200 includes an outer casing that surrounds and protects the inner tubular sting 104. The running tool 200 is supported by the rig by a running tool extension member 201 that is connected to the main running tool 200 by a quick connector 203. Multiple extension members 201 can be used to accommodate various drilling rig heights. The tubular string 104 (FIG. 1) may be at least partially centered within the running tool 200 by a casing collar 206. The casing collar 206 is positioned within an annulus defined by an outer surface of the tubular 122 and an inner surface of the running tool 200. The casing collar 206 reduces a clearance between the running tool 200 and the tubular string 104.

At a downhole end of the running tool 200 are a set of slips 202 retained within a slip bowl 204. The slips 202 and the slip bowl 204 make-up a slip assembly 207. The slip assembly 207 can act as the TSD 134 (FIG. 1). The slips 202 can move from a first, retracted position 202*a* within the bowl 204 to a second, engaged position 202*b* within the bowl 204. The slips 202 are installed around the tubular string 104, while in the retracted position 202*a*. The slips 202 are held in the retracted position 202*a* by shear pins 208. In some implementations, the slips 202 can be held in the retracted position 202*a* by a hydraulic system, a threaded connection, or any other retaining mechanism. In the retracted position, the slips 202 can run over a reduced clearance, such as over a casing collar. The slips 202 can be moved to the engaged position by shearing the shear pins 208 with a longitudinal and/or rotational displacement (i.e., turning a portion of the running tool). In some implementations, the slips 202 can be move to the engaged position with a hydraulic actuator. Once in the engaged position, the slips 202 can at least partially support the tubular 122 within the wellbore. The bowl 204 is also configured to be released from the running tool 200 once the slips 202 are engaged. The bowl 204 can be released by shearing a set of shear pins 210, unthreading a threaded connection, or through any other release mechanism. The entire slip assembly 207 is configured to be permanently installed in the wellbore. In some implementations, the running tool 200 can include a protective housing 212. The housing 212 is designed to reduce damage to the running tool 200 or wellhead 130 when cutting the tubular 122 from within the wellhead 130.

Figure 3:
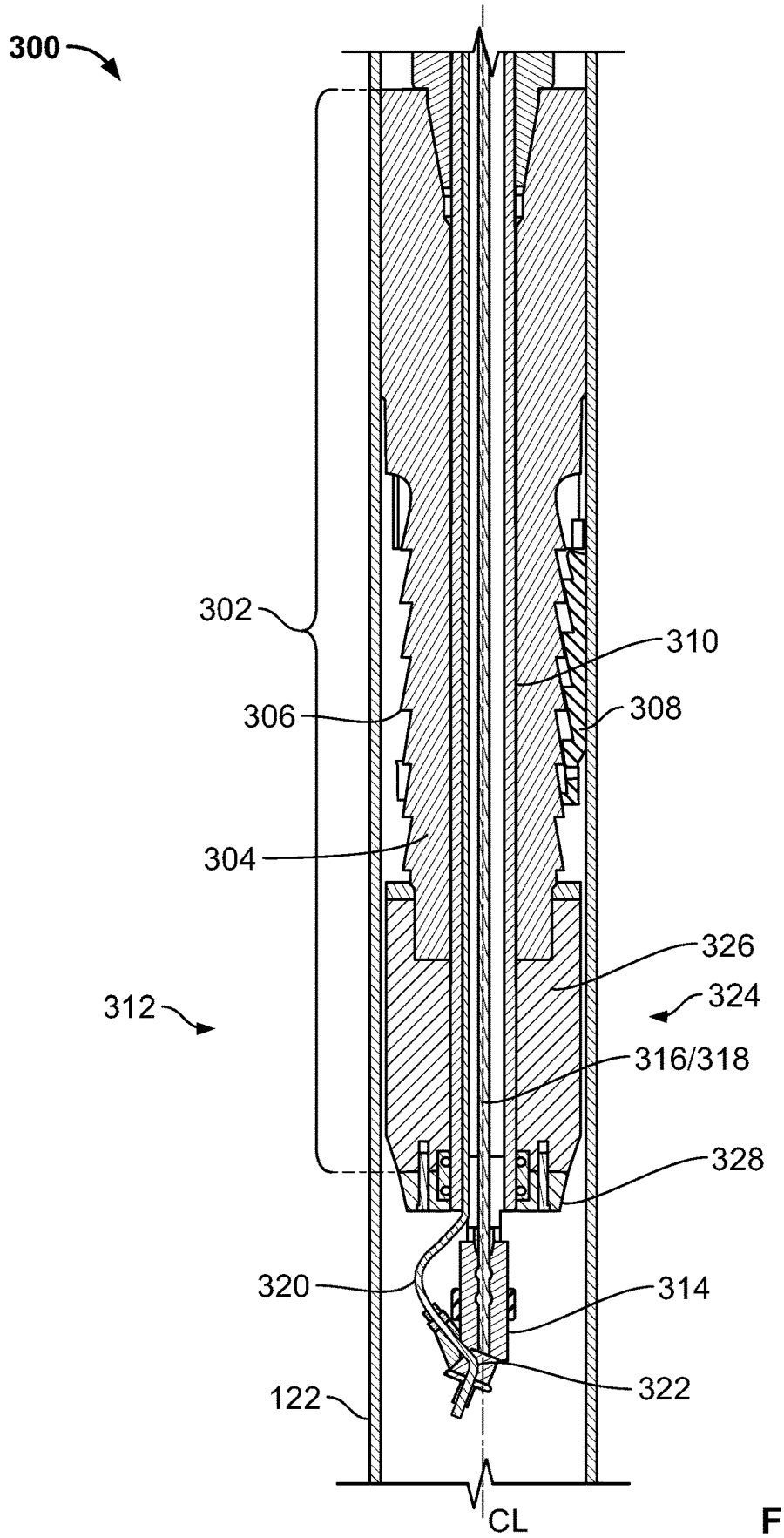
FIG. 3 is a half, side cross-sectional view of an example cutting system.

FIG. 3 is a half, side cross-sectional view of an example tubular cutting system 300. The system 300 includes a grapple system 302 that is configured to support the tubular 122. In the illustrated example, the grapple system 302 includes a mechanically actuated expandable slip 308. The slip 308 is configured to grip the tubular 122 with a friction fit. While the grapple system 302 has been described with an internal gripping configuration, an external grip configuration, sometimes referred to as an overshot, can be used without departing from this disclosure.

A rotatable drive tube 310 passes through the center of the grapple system 302. The drive tube 310 is configured to be rotated during severing operations. A tubular string cutter assembly 312 is positioned at a downhole end of the drive tube 310 and the downhole end of the grapple system 302.

As illustrated, the tubular string cutter assembly 302 includes a water jet cutter head 314 configured to be rotated by the rotatable drive tube 310 within the tubular string 104. In other configurations, the water jet could be exterior the tubular string 104 and configured to rotate around the exterior of the tubular string 104. The water jet cutter head 314 is configured to direct a high velocity fluid jet at the tubular string 104, and is capable of severing the tubular string 104. The cutter assembly 312 includes a media line 316 that delivers a liquid media to the water jet cutter head 314. The liquid media can be pressurized at a topside facility and can include water, oil, air, or any other appropriate fluid for cutting the tubular string 104. The cutter assembly 312 may also include instrumentation line 318 configured to exchange commands and data with the water jet cutter head 314. In some implementations, the cutter assembly 312 can include a second media line 320 configured to deliver a second media to the water jet cutter head. In some implementations, the second media line 320 is configured to carry an abrasive media, such as silica or garnet particles. The cutter assembly can include a mixer 322 to mix the liquid media and the second media.

The cutter assembly 312 includes a support assembly 324 with a main body 326 positioned at a downhole end of the grapple system 302. The main body 326 can be attached to the grapple by one of several threaded elements typically used for drilling operations or take the form of a quick connect mechanism. The main body 326 includes a bearing assembly 328 configured to radially support the drive tube 310 and the cutter head 314. In some implementations, the bearing assembly 328 can at least partially axially support the drive tube 310.

The grapple system 302 supports both the cutter assembly 312 and the tubular string 104. The system 300 is configured to sever the tubular 122 at a predetermined point after suspension of the tubular within the wellhead 130. While described as a water jet cutter, the cutting assembly can take the form of mechanical blades, or abraders, laser discharge, plasma torch, or other cutting devices and methods without departing from this disclosure. The grapple is arranged such that the cutting mechanism, grapple mechanism, and the cut casing may be retrieved as one assembly. In some implementations, the grapple mechanism and/or the cutting mechanism provides one or more passageways by which various fluid, media, or instrumentation lines or conduits may be ran and protected from damage.

Aspects of this disclosure can be implemented with a method performed through the BOP on a wellbore. In the method, a tubular string is cut and the severed tubular removed using a severing system inserted through the BOP into the tubular string and landed in a fit-for-purpose wellhead. Cutting the tubular string forms both an excess tubular string and a remaining tubular string. The excess tubular string is uphole of the remaining tubular string. The excess tubular string is removed through the BOP.

The processes and components described can also be used to cut any string of tubular. While aspects of this disclosure primarily discuss hydrocarbon production wells, similar processes and components can be used for injection and disposal wells. The processes and components discussed within this disclosure are especially suited for land and offshore wells (i.e., wells on the continental shelf, lakes, inshore waters and inland seas), but could be useful to other types of wells, including subsea wells.

The method and system of the present disclosure have been described above and in the attached drawings; however, modifications derived from this description will be apparent to those of ordinary skill in the art and the scope of protection for the disclosure is to be determined by the claims that follow.

The invention claimed is:

1. A method performed through a BOP on a wellbore, the method comprising:

severing a tubular string using a severing system inserted through the BOP, the severing forming an excess tubular string and a remaining tubular string, wherein the tubular is severed above a cellar floor and below the BOP; and removing the excess tubular string through the BOP.

2. The method of claim 1, further comprising:

inserting the tubular string into a wellbore through the BOP; and setting the tubular string to be supported within the wellbore.

3. The method of claim 1, where severing comprises severing the tubular from inside the tubular.

4. The method of claim 1, where severing the tubular string comprises using a water jet cutter.

5. The method of claim 4, where the water jet cutter directs a high velocity jet of fluid with a suspended abrasive media.

6. The method of claim 1, comprising supporting the severing system from a rig.

7. The method of claim 6, comprising supporting the severing system on a rod, drill string, or coiled tubing.

8. The method of claim 1, wherein the tubular is severed prior to completing a well.

9. The method of claim 1, wherein a proximity sensor is positioned within the wellbore, the method comprising locating the severing system based on the proximity sensor.

10. The method of claim 9, wherein the proximity sensor comprises a linear variable differential transformer or a shoulder stop.

11. A casing cutting system comprising:

a grapple assembly configured to support a tubular string; the grapple assembly configured to be inserted into the tubular string and support the tubular string by an inner wall of the tubular string;

a rotatable drive tube passing through the center of the grapple assembly, the drive tube configured to be rotated;

a tubular string cutter assembly positioned at a downhole end of the drive tube, the tubular string cutter assembly positioned downhole of the grapple assembly, the tubular string cutter configured to sever the tubular string; and a proximity sensor positioned within the tubular string, the proximity sensor positioned such that the tubular string cutter can be positioned based on the proximity sensor, wherein the proximity sensor is positioned above a cellar floor and below a BOP.

12. The casing cutting system of claim 11, where the tubular string cutter assembly comprises;

a water jet cutter head configured to be rotated within the tubular string, the water jet cutter being rotatable by the rotatable drive tube, the water jet cutter configured to direct a high velocity fluid jet at the inner wall of the tubular string;

a media line configured to deliver a liquid media to the water jet cutter head; and an instrumentation line configured to exchange commands and data with the water jet cutter head.

13. A casing cutting system comprising:

a grapple assembly configured to support a tubular string; the grapple assembly configured to be inserted into the tubular string and support the tubular string by an inner wall of the tubular string;

a rotatable drive tube passing through the center of the grapple assembly, the drive tube configured to be rotated;

a tubular string cutter assembly positioned at a downhole end of the drive tube, the tubular string cutter assembly positioned downhole of the grapple assembly, the tubular string cutter configured to sever the tubular string;

a water jet cutter head configured to be rotated within the tubular string, the water jet cutter being rotatable by the rotatable drive tube, the water jet cutter configured to direct a high velocity fluid jet at the inner wall of the tubular string;

a media line configured to deliver a liquid media to the water jet cutter head; and an instrumentation line configured to exchange commands and data with the water jet cutter head; and a support assembly comprising:

a main body positioned at a downhole end of the grapple assembly; and a bearing assembly configured to radially support the drive tube and the cutter assembly.

14. The casing cutting system of claim 12, where the media line is a first media line, the tubular string cutter assembly further comprising:

a second media line configured to deliver a second media to the water jet cutter head; and a mixer configured to mix the liquid media and second media.

15. The casing cutting system of claim 14, where the second media line is configured to carry an abrasive media.

16. A method performed through a BOP on a wellbore, the method comprising:

inserting a tubular string into a wellbore through the BOP;

setting the tubular string to be supported within the wellbore;

severing the tubular string, from inside the tubular string, using a water-jet cutting system inserted through the BOP, the severing forming an excess tubular string and a remaining tubular string, wherein the tubular is severed above a cellar floor and below the BOP; and removing the excess tubular string through the BOP.

17. The method of claim 16, comprising supporting the water-jet cutting system on a rod, drill string, or coiled tubing.

18. The method of claim 16, wherein severing the tubular string comprises beveling the remaining tubular string.

* * * * *